US009369793B2

(12) United States Patent
Huang

(10) Patent No.: US 9,369,793 B2
(45) Date of Patent: Jun. 14, 2016

(54) AUDIO PLAYBACK SYSTEM, EARPHONE AND METHOD FOR CONTROLLING AUDIO PLAYBACK SYSTEM

(71) Applicant: Chiun Mai Communication Systems, Inc., New Taipei (TW)

(72) Inventor: Chao-Sheng Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 16 days.

(21) Appl. No.: 14/464,248

(22) Filed: Aug. 20, 2014

(65) Prior Publication Data

US 2015/0055792 A1 Feb. 26, 2015

(30) Foreign Application Priority Data

Aug. 22, 2013 (CN) ..... 2013 1 0375562

(51) Int. Cl.
*H04R 1/06* (2006.01)
*H04R 1/10* (2006.01)

(52) U.S. Cl.
CPC ..... *H04R 1/1041* (2013.01); *H04R 1/06* (2013.01)

(58) Field of Classification Search
None
See application file for complete search history.

(56) References Cited

U.S. PATENT DOCUMENTS 8,731,208 B2 * 5/2014 Han ..... H04R 1/1041 381/123
2001/0000459 A1 * 4/2001 Kania ..... A61M 21/00 381/98
2006/0014560 A1 * 1/2006 Yoshino ..... H01Q 1/46 455/550.1
2007/0160255 A1 * 7/2007 Cheng ..... H04R 1/1016 381/384
2008/0157991 A1 * 7/2008 Raghunath ..... G11B 31/02 340/686.1
2008/0158000 A1 * 7/2008 Mattrazzo ..... H04M 1/05 340/4.4
2009/0136058 A1 * 5/2009 Choi ..... H04R 5/04 381/74
2010/0075723 A1 * 3/2010 Min ..... H01R 24/58 455/569.1
2010/0310087 A1 * 12/2010 Ishida ..... H04R 1/1041 381/74
2012/0237051 A1 * 9/2012 Lee ..... H01R 13/66 381/74
2012/0317314 A1 * 12/2012 Choi ..... H04M 1/72527 710/8
2014/0314247 A1 * 10/2014 Zhang ..... H04R 1/1041 381/74
2015/0055792 A1 * 2/2015 Huang ..... H04R 1/1041 381/74

FOREIGN PATENT DOCUMENTS

JP 62-178690 U 11/1987
JP 2007-121694 A 5/2007
WO 2013/098974 A1 7/2013

* cited by examiner

*Primary Examiner* — Peter Vincent Agustin
(74) *Attorney, Agent, or Firm* — Novak Druce Connolly Bove + Quigg LLP

(57) ABSTRACT

An audio playback system includes an earphone and an audio device. The earphone includes a first earphone body, a second earphone body, a first sensing unit mounted in the first earphone body, a second sensing unit mounted in the second earphone body, a first plug, and a second plug electronically connected to the first sensing unit and the second sensing unit. The audio device includes a first jack, a second jack configured to receive the second plug, and a control unit. The first sensing unit and the second sensing unit output sensing signals which indicate whether the earphone is used. The control unit receives the sensing signals from the second jack and controls a working state of the audio device.

15 Claims, 3 Drawing Sheets

AUDIO PLAYBACK SYSTEM, EARPHONE AND METHOD FOR CONTROLLING AUDIO PLAYBACK SYSTEM

FIELD

The subject matter herein generally relates to an audio playback system, an earphone, and a method for controlling the audio playback system.

BACKGROUND

Audio devices, such as mobile phones, tablet computers, and other devices with a function of playing audio files, generally output audio using an earphone. A user commonly controls the audio devices with a control switch mounted on the earphone.

BRIEF DESCRIPTION OF THE DRAWINGS

Implementations of the present technology will now be described, by way of example only, with reference to the attached figures.

DETAILED DESCRIPTION

Figure 1:
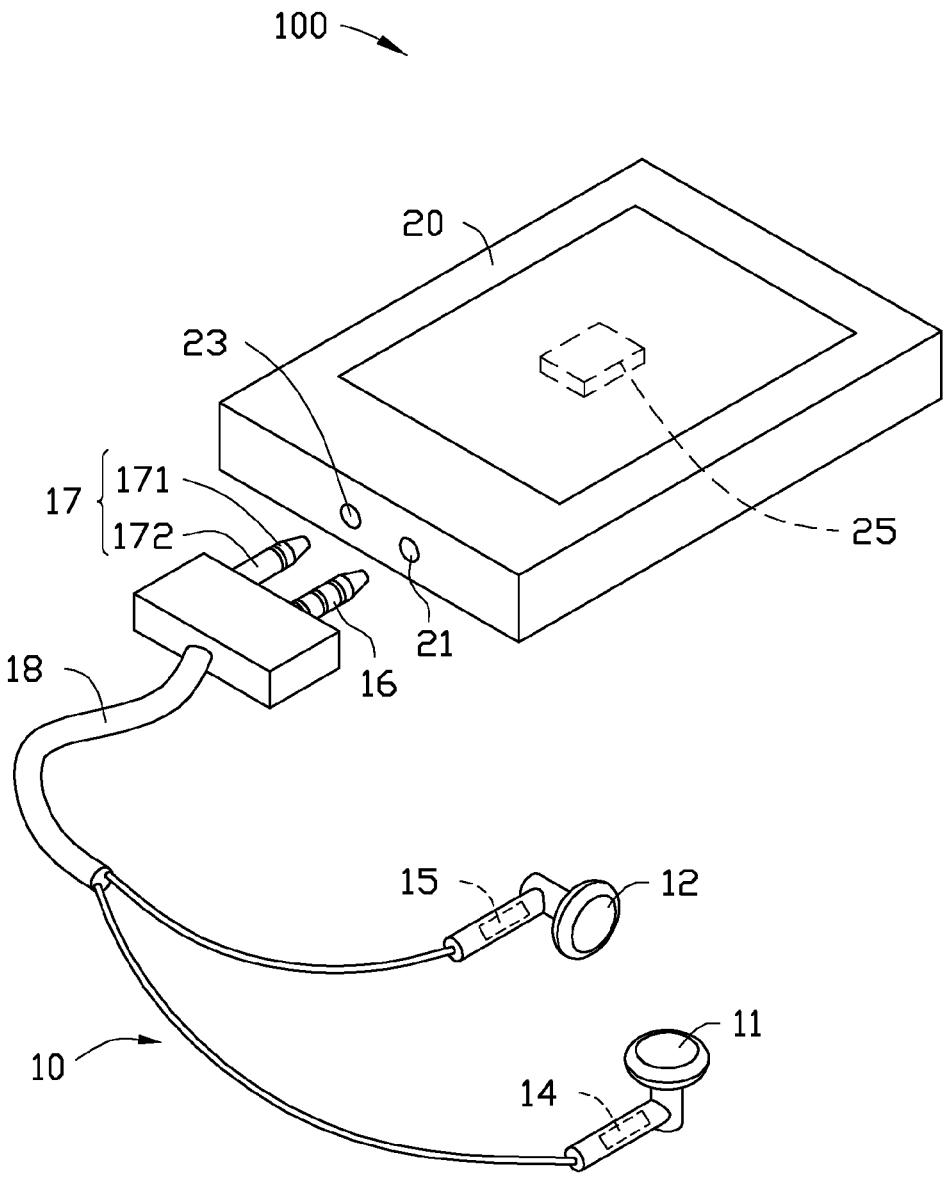
FIG. 1 is an isometric view of an embodiment of an audio playback system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of an audio playback system 100. The audio playback system 100 includes an earphone 10 and an audio device 20. The earphone 10 includes a first earphone body 11, a second earphone body 12, a first sensing unit 14, a second sensing unit 15, a first plug 16, and a second plug 17. As illustrated, the first sensing unit 14 is mounted in the first earphone body 11. The second sensing unit 15 is mounted in the second earphone body 12. In this embodiment, the first plug 16 can be a three pin earphone plug or a four pin earphone plug. The second plug 17 is electronically connected to the first sensing unit 14 and the second sensing unit 15.

The audio device 20 can be a mobile phone, a tablet computer, or another device having a function of playing audio files. The audio device 20 includes a first jack 21, a second jack 23, and a control unit 25. As illustrated, the first jack 21 is configured to receive the first plug 16 and establish an electronic connection with the earphone 10. The second jack 23 is configured to receive the second plug 17. The control unit 25 can be a central processing unit (CPU) and is electronically connected to the second jack 23. The first sensing unit 14 and the second sensing unit 15 can output sensing signals which indicate whether the earphone 10 is used. The control unit 25 receives the sensing signals by the second jack 23 and controls a working state of the audio device 20 according to the received sensing signals.

In this embodiment, the first sensing unit 14 and the second sensing unit 15 are both light sensors. Thus, when at least one of the first earphone body 11 and the second earphone body 12 keeps in touch with an ear of a user, the at least one of the first sensing unit 14 and the second sensing unit 15 outputs a first sensing signal, for example, logic 0. When both the first earphone body 11 and the second earphone body 12 do not keep in touch with the ear, the first sensing unit 14 and the second sensing unit 15 both output a second sensing signal, for example, logic 1, different from the first sensing signal.

As illustrated, when the at least one of the first earphone body 11 and the second earphone body 12 keeps in touch with the ear of the user, the at least one of the first sensing unit 14 and the second sensing unit 15 cannot receive any light or can only receive a little light which is less than a predetermine value to output the first sensing signal. When both the first earphone body 11 and the second earphone body 12 do not keep in touch with the ear, the first sensing unit 14 and the second sensing unit 15 can both receive light which is larger than the predetermine value to output the second sensing signal. That is, the control unit 25 can determine whether the earphone 10 is used according to the received first sensing signal and the second signal.

In detail, when the at least one of the first sensing unit 14 and the second sensing unit 15 outputs the first sensing signal, the control unit 25 determines the earphone 10 is used and controls the audio device 20 to keep working, for example, starting to play audio files or keeping on playing audio files. When the first sensing unit 14 and the second sensing unit 15 both output the second sensing signal, the control unit 25 determines the earphone 10 is not used and controls the audio device 20 to stop working, for example, stop playing audio files.

Figure 2:
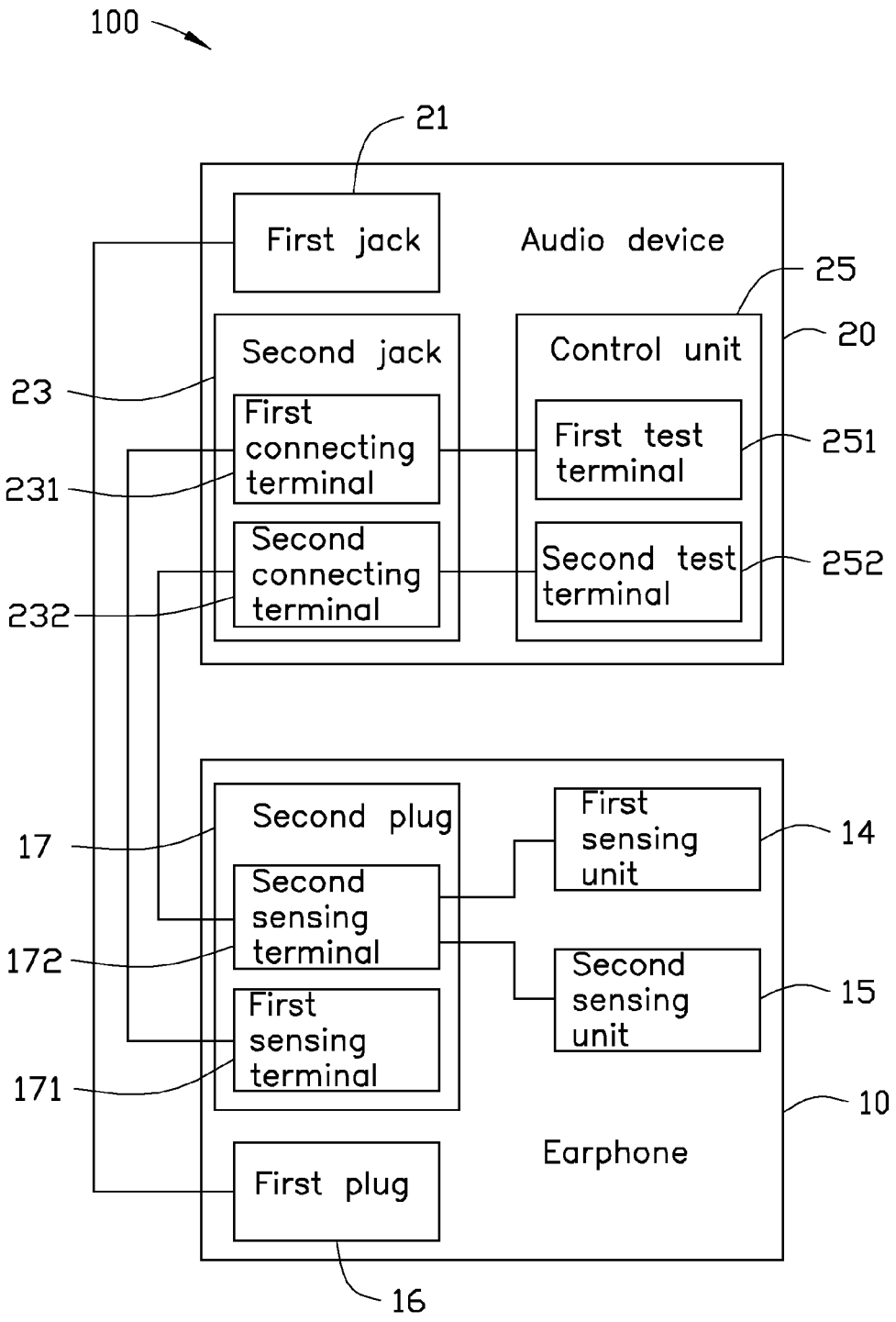
FIG. 2 is a block diagram of the audio playback system of FIG. 1.

FIG. 2 illustrates that the second plug 17 includes a first sensing terminal 171 and a second sensing terminal 172. There is an insulating material positioned between the first sensing terminal 171 and the second sensing terminal 172.

The second jack 23 includes a first connecting terminal 231 and a second connecting terminal 232. The first connecting terminal 231 is corresponding to the first sensing terminal 171 and can be electronically connected to the control unit 25. The second connecting terminal 232 is corresponding to the second sensing terminal 172. The first sensing unit 14 and the second sensing unit 15 can be electronically connected to the second sensing terminal 172 and output the first sensing signal and the second sensing signal by the second sensing terminal 172 and the second connecting terminal 232.

In this embodiment, the control unit 25 can further determine a type of the earphone 10 received in the audio device 20 according to a connecting state between the first connecting terminal 231 and the first sensing terminal 171. In detail, the control unit 25 can determine that the earphone 10 with the first sensing unit 14 and the second sensing unit 15 is received in the audio device 20 when the first connecting terminal 231 is electronically connected to the first sensing terminal 171. The control unit 25 can determine that an earphone without the first sensing unit 14 and the second sensing unit 15 is received in the audio device 20 when the first connecting terminal 231 is disconnected from the first sensing terminal 171.

As illustrated, the control unit 25 includes a first test terminal 251 and a second test terminal 252. The first test terminal 251 is electronically connected to the first connecting terminal 231 that the control unit 25 determines the type of the earphone 10 received in the first jack 21 by the first test terminal 251. The second test terminal 252 is electronically connected to the second connecting terminal 232 that the control unit 25 can receive the first sensing signal and the second sensing signal by the second test terminal 252 and the second connecting terminal 232.

In other embodiments, the earphone 10 can further include an earphone line 18. The earphone line 18 is configured to electronically connect the first earphone body 11 and the second earphone body 12 to the first plug 16 and electronically connect the first sensing unit 14 and the second unit 15 to the second plug 17.

Figure 3:
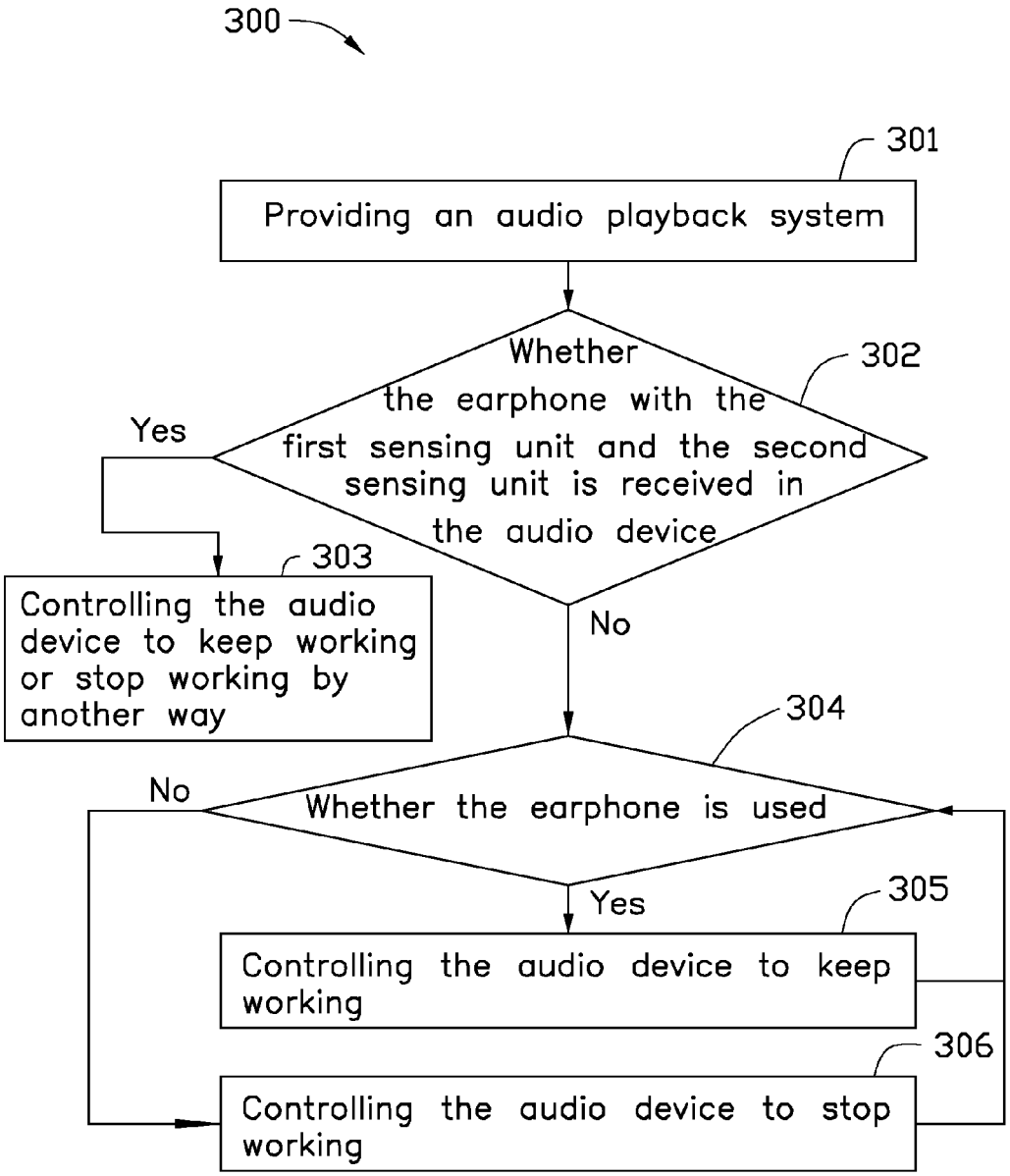
FIG. 3 is a flowchart of an embodiment of a method for controlling the audio playback system of FIG. 1.

Referring to FIG. 3, a flowchart is presented in accordance with an example embodiment which is being thus illustrated. The example method 300 is provided by way of example, as there are a variety of ways to carry out the method. The method 300 described below can be carried out using the configurations illustrated in FIGS. 1 and 2, for example, and various elements of these figures are referenced in explaining example method 300. Each block shown in FIG. 3 represents one or more processes, methods or subroutines, carried out in the exemplary method 300. Additionally, the illustrated order of blocks is by example only and the order of the blocks can change according to the present disclosure. The exemplary method 300 can begin at block 301.

At block 301, an audio playback system 100 is provided. The audio playback system 100 includes an earphone 10 and an audio device 20 configured to receive and electronically connect to the earphone 10. The earphone 10 includes a first sensing unit 14 and a second sensing unit 15.

At block 302, the audio device 20 determines whether the earphone 10 with the first sensing unit 14 and the second sensing unit 15 is physically and electronically connected to the audio device 20.

At block 303, the audio device 20 is controlled to keep working or stop working by another way when the earphone 10 without the first sensing unit 14 and the second sensing unit 15 is determined to be received in the audio device 20, for example, the audio device 20 is controlled to keep working or stop working by a control switch mounted on the earphone 10.

At block 304, the audio device 20 detects sensing signals output by the first sensing unit 14 and the second sensing unit 15 to determine whether the earphone 10 is used when the earphone 10 with the first sensing unit 14 and the second sensing unit 15 is determined to be received in the audio device 20.

At block 305, the audio device 20 is controlled to keep working when the earphone 10 is determined to be used and goes back to block 304.

At block 306, the audio device 20 is controlled to stop working when the earphone 10 is determined to be not used and goes back to block 304.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An audio playback system, comprising:

an earphone, comprising:

a first earphone body;

a second earphone body;

a first sensing unit mounted in the first earphone body;

a second sensing unit mounted in the second earphone body;

a first plug; and a second plug comprising a first sensing terminal and a second sensing terminal, the second sensing terminal electronically connected to the first sensing unit and the second sensing unit; and an audio device, comprising:

a first jack configured to physically and electronically connect to the first plug to transmit audio signals to the earphone;

a second jack comprising a first connecting terminal corresponding to the first sensing terminal and a second connecting terminal corresponding to the second sensing terminal; and a control unit electronically connected to the second jack;

wherein the first sensing unit and the second sensing unit output sensing signals by the second sensing terminal and the second connecting terminal which indicate whether the earphone is used; the control unit receives the sensing signals from the second jack and controls a working state of the audio device according to the received sensing signals.

2. The audio playback system of claim 1, wherein the earphone further comprises an earphone line configured to electronically connect the first earphone body and the second earphone body to the first plug and electronically connect the first sensing unit and the second sensing unit to the second plug.

3. The audio playback system of claim 1, wherein the first sensing unit and the second sensing unit are both optical sensors, when at least one of the first earphone body and the second earphone body keeps in touch with an ear of a user, the at least one of the first sensing unit and the second sensing unit outputs a first sensing signal; when both the first earphone body and the second earphone body do not keep in touch with the ear, the first sensing unit and the second sensing unit both output a second sensing signal opposite to the first sensing signal.

4. The audio playback system of claim 3, wherein when the at least one of the first sensing unit and the second sensing unit outputs the first sensing signal, the control unit determines the earphone is used and controls the audio device to keep working; when the first sensing unit and the second sensing unit both output the second sensing signal, the control unit determines the earphone is not used and controls the audio device to stop working.

5. The audio playback system of claim 1, wherein the first connecting terminal is electronically connected to the control unit, the control unit determines a type of the earphone received in the audio device according to a connecting state between the first connecting terminal and the first sensing terminal.

6. The audio playback system of claim 5, wherein the control unit determines that the earphone with the first sensing unit and the second sensing unit is received in the audio device when the first connecting terminal is electronically connected to the first sensing terminal.

7. The audio playback system of claim 5, wherein the control unit comprises a first test terminal electronically connected to the first connecting terminal, the control unit determines the type of the earphone received in the audio device by the first test terminal.

8. The audio playback system of claim 3, wherein the control unit further comprises a second test terminal electronically connected to the second connecting terminal, the control unit receives the first sensing signal and the second sensing signal by the second test terminal.

9. An earphone for an audio device, the earphone comprising:

a first earphone body;

a second earphone body;

a first sensing unit mounted in the first earphone body;

a second sensing unit mounted in the second earphone body;

a first plug configured to be received in a first jack of the audio device; and a second plug comprising a first sensing terminal and a second sensing terminal, the second sensing terminal electronically connected to the first sensing unit and the second sensing unit;

wherein the first sensing unit and the second sensing unit output sensing signals by the second sensing terminal which indicate whether the earphone is used; the second plug is configured to be received in a second jack of the audio device for the audio device detecting the sensing signals.

10. The earphone of claim 9, wherein the earphone further comprises an earphone line configured to electronically connect the first earphone body and the second earphone body to the first plug and electronically connect the first sensing unit and the second sensing unit to the second plug.

11. The earphone of claim 9, wherein the first sensing unit and the second sensing unit are both optical sensors, when at least one of the first earphone body and the second earphone body keeps in touch with an ear of a user, the at least one of the first sensing unit and the second sensing unit outputs a first sensing signal; when both first earphone body and the second earphone body do not keep in touch with the ear, the first sensing unit and the second sensing unit both output a second sensing signal opposite to the first sensing signal.

12. The earphone of claim 11, wherein when the at least one of the first sensing unit and the second sensing unit outputs the first sensing signal, the audio device determines the earphone is used; when the first sensing unit and the second sensing unit both output the second sensing signal, the audio device determines the earphone is not used.

13. The earphone of claim 9, wherein the first sensing terminal is configured for the audio device to determine a type of the earphone received in the first jack.

14. A method for controlling an audio playback system, comprising:

providing the audio playback system which comprises an earphone and an audio device configured to receive the earphone, the earphone comprising a first sensing unit, a second sensing unit, a first plug configured to be received in a first jack of the audio device, and a second plug, the second plug comprising a first sensing terminal and a second sensing terminal, the second sensing terminal electronically connected to the first sensing unit and the second sensing unit;

detecting sensing signals output by the first sensing unit and the second sensing unit through the second sensing terminal to determine whether the earphone is used;

controlling the audio device to keep working when the earphone is determined to be used; and controlling the audio device to stop working when the earphone is determined to be not used.

15. The method of claim 14, furthering comprising:

determining whether the earphone with the first sensing unit and the second sensing unit is received in the audio device; and detecting the sensing signals output by the first sensing unit and the second sensing unit to determine whether the earphone is used when the earphone with the first sensing unit and the second sensing unit is determined to be received in the audio device.

* * * * *